US006604582B2

(12) United States Patent
Flowers et al.

(10) Patent No.: US 6,604,582 B2
(45) Date of Patent: Aug. 12, 2003

(54) DOWNHOLE FLUID PRESSURE SIGNAL GENERATION AND TRANSMISSION

(75) Inventors: Joseph K. Flowers, Houston, TX (US); Michael L. Smith, Missouri City, TX (US); Jeffrey Beckel, Sugar Land, TX (US); Sarmad Adnan, Sugar Land, TX (US); Lawrence J. Leising, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 193 days.

(21) Appl. No.: 09/843,634

(22) Filed: Apr. 26, 2001

(65) Prior Publication Data

US 2003/0000707 A1 Jan. 2, 2003

Related U.S. Application Data

(60) Provisional application No. 60/209,418, filed on Jun. 5, 2000.

(51) Int. Cl.[7] ..... E21B 34/00; E21B 34/08

(52) U.S. Cl. ..... 166/332.1; 166/321; 137/625.17

(58) Field of Search ..... 166/332.3, 332.1, 166/320, 321; 137/625.17, 599.01

(56) References Cited

U.S. PATENT DOCUMENTS

| | | | | |
|---|---|---|---|---|
| 3,711,825 | A | | 1/1973 | Gearhart et al. |
| 3,713,089 | A | | 1/1973 | Claycomb |
| 3,736,558 | A | | 5/1973 | Cubberly |
| 3,764,969 | A | | 10/1973 | Cubberly |
| 3,949,354 | A | | 4/1976 | Claycomb |
| 3,958,217 | A | | 5/1976 | Spinnler |
| 3,964,556 | A | | 6/1976 | Gearhart et al. |
| 3,997,867 | A | | 12/1976 | Claycomb |
| 4,078,620 | A | | 3/1978 | Westlake et al. |
| 4,120,097 | A | | 10/1978 | Jeter |
| 4,184,545 | A | | 1/1980 | Claycomb |
| 4,235,021 | A | | 11/1980 | Claycomb |
| 4,281,678 | A | | 8/1981 | Claycomb |
| 4,519,574 | A | * | 5/1985 | Roper |
| 5,073,877 | A | | 12/1991 | Jeter |
| 5,586,084 | A | * | 12/1996 | Barron et al. |
| 5,626,192 | A | | 5/1997 | Connell et al. |
| 5,740,127 | A | * | 4/1998 | Van Steenwyk et al. |
| 5,836,353 | A | * | 11/1998 | Van Steenwyk |
| 6,305,467 | B1 | | 10/2001 | Connell et al. |

OTHER PUBLICATIONS

Halliburton, *DepthPro* [SM]*Service Frequently Asked Questions* (*Wireless Coiled Tubing Collar Locator*) (No date).

ML Connell et al., "High–Pressure/High–Temperature Coiled Tubing Casing Collar Locator Provides Accurate Depth Control for Single–Trip Perforating," *SPE 60698 SPE/CoTA Coiled Tubing Roundtable*, pp. 1–9, Houston, Texas (Apr. 5–6, 2000).

ML Connell et al., "Development of a Wireless Coiled Tubing Collar Locator," *SPE 54327 SPE Asia Pacific Oil and Gas Conference and Exhibition*, pp. 53–59, Jakarta, Indonesia (Apr. 20–22, 1999).

Halliburton, *DepthPro* ™*Wireless Coiled Tubing Collar Locator* brochure, Halliburton Energy Services (1999).

* cited by examiner

*Primary Examiner*—Roger Schoeppel
(74) *Attorney, Agent, or Firm*—Wayne I. Kanak; Brigitte L. Jeffery; John J. Ryberg

(57) ABSTRACT

A system is disclosed for communication from an instrument disposed in a wellbore. The system includes a flow diverter selectively operable to conduct fluid flow between a first path along the interior of a housing and a second path along the interior of the housing. The system includes an initiator operatively coupled to the flow diverter to cause selective operation thereof in response to an event.

80 Claims, 4 Drawing Sheets

DOWNHOLE FLUID PRESSURE SIGNAL GENERATION AND TRANSMISSION

CROSS-REFERENCE TO RELATED APPLICATIONS

This application claims priority from U.S. Provisional Application serial No. 60/209,418 filed on Jun. 5, 2000.

BACKGROUND OF THE INVENTION

1. Field of the Invention

The invention relates generally to downhole instruments used to transmit an indication of the occurrence of event(s). More particularly, the invention relates to fluid pressure modulation telemetry systems used with such instruments to transmit the indications.

2. Description of the Related Art

Drilling and completion systems known in the art include so called measurement-while-drilling (MWD) systems. MWD systems include one or more sensors disposed in an instrument lowered into the wellbore, typically during the drilling, completion, or treatment thereof, which detect a physical parameter related to a condition in the wellbore or to a property of the formations surrounding the wellbore. MWD systems also include electronic circuitry which converts the measurements made by the one or more sensors into a representative signal which is applied to some form of fluid pressure modulation telemetry. Pressure modulation telemetry uses a device to alter the flow of drilling or treatment fluid through the instrument in a predetermined manner to communicate the representative signal to the earth's surface. The signal is detected typically by one or more pressure sensors disposed at the earth's surface in the fluid circulation system. A detection, interpretation and recording system coupled to the pressure sensor decodes the representative signal to extract the measurement made by the one or more sensors. Typical MWD systems are described, for example, in U.S. Pat. Nos. 3,958,217; 3,964,556; 3,736,558; 4,078,620; and 5,073,877.

A problem common to all prior art MWD pressure modulation telemetry systems is pressure noise in the fluid circulation system. Such noise can be caused by, among other things, pulsations in the output of the fluid circulation pump, and vibrations and shocks caused by the movement of the drilling equipment (and consequently the instrument itself). Pressure noise can make detection of the MWD telemetry signal difficult, particularly at high data rates. It is common in MWD telemetry to represent the value of the representative signal as a binary coded decimal "word" including a number of digital bits related to the measurement range for the particular one of the sensors represented in the telemetry signal. As is known in the art, various modulation techniques are applied to the fluid pressure to represent digital "ones" and "zeroes" in the telemetry. Typical modulation techniques include momentary pressure increases (positive pulse telemetry), momentary pressure decreases (negative pulse telemetry) and phase shift keying of a standing wave (mud siren).

Detection of the proper sequence of binary coded information to recover the representative signal is difficult in noisy conditions, and may require expensive and difficult to operate equipment at the earth's surface. Further, the typical telemetry generator used in MWD systems is expensive to make and to operate. Finally, detection of certain types of downhole conditions can be represented by more simple telemetry signals than are provided in the typical MWD telemetry system.

One solution to the limitations of conventional MWD telemetry for use in transmitting simple indications of a downhole condition is described, for example, in U.S. Pat. No. 5,626,192 issued to Connell et al. The device described in this patent is a casing collar locator which is adapted to be operated at the end of a string of coiled tubing. A casing collar detector in the instrument conducts electrical signals to a controller in the instrument, which upon receipt of a collar detection signal, operates a valve consisting of a set of lateral ports. The ports, when opened, conduct some of the fluid flowing through the instrument to the annular space between the outside of the coiled tubing and the wellbore wall. While the instrument in the Connell et al '192 patent has proven effective, there are circumstances where diverting fluid flow from the interior of the tubing/instrument to the annular space outside them is undesirable. Such circumstances include, but are not limited to, setting a plug or pumping acid or scale removal chemicals through the coiled tubing and the instrument.

What is needed is a fluid pressure telemetry system which provides robust, easy to detect signals at the earth's surface, and maintains fluid flow within the instrument.

SUMMARY OF THE INVENTION

One aspect of the invention is a system for communication from an instrument disposed in a wellbore. The system includes a flow diverter selectively operable to conduct fluid flow through a first path along the interior of a housing and a second path along the interior of the housing. The system includes an initiator operatively coupled to the flow diverter to cause selective operation thereof in response to a first event.

The first event can comprise any of a number of occurrences, including but not limited to, the detection of certain downhole components, the sensing of certain wellbore conditions, the sensing of certain tool string or tool component conditions, the sensing of certain formation characteristics, the expiration of a period of time, the execution of a software program or subroutine, or the reception or transmission of a signal from or to components at the surface or in the wellbore. Depending on the nature of the first event, the initiator may also include at lease one detector, software program, analyzer, timer, or sensor (to name a few) in order to sense the occurrence of the first event. Generally, when the initiator senses the first event, the flow diverter diverts at least some of the fluid flow to the second flow path, which creates a pressure change that can be sensed and that serves as an indication of the occurrence of the event.

In one embodiment, the flow diverter is a piston operated by an actuator. One embodiment of the actuator is a ball screw operated by an electric motor. One embodiment of the initiator is operatively attached to a casing collar locator wherein the first event comprises the detection of a casing collar by the locator. Upon detection of a casing collar in the wellbore, the piston is moved from a first position to a second position, to divert flow from the first path to the second path, for a selected amount time, to indicate detection of the casing collar.

A method for communicating from an instrument disposed in a wellbore according to another aspect of the invention includes conducting fluid flow through a first path having a first flow restriction. The first flow path is located along the interior of the instrument. Upon the occurrence of a first event, the fluid flow is diverted along a second path having a second flow restriction in response to the first event. The second path is located along the interior of the instrument.

Other aspects and advantages of the invention will be apparent from the following description and the appended claims.

DETAILED DESCRIPTION

Figure 1:
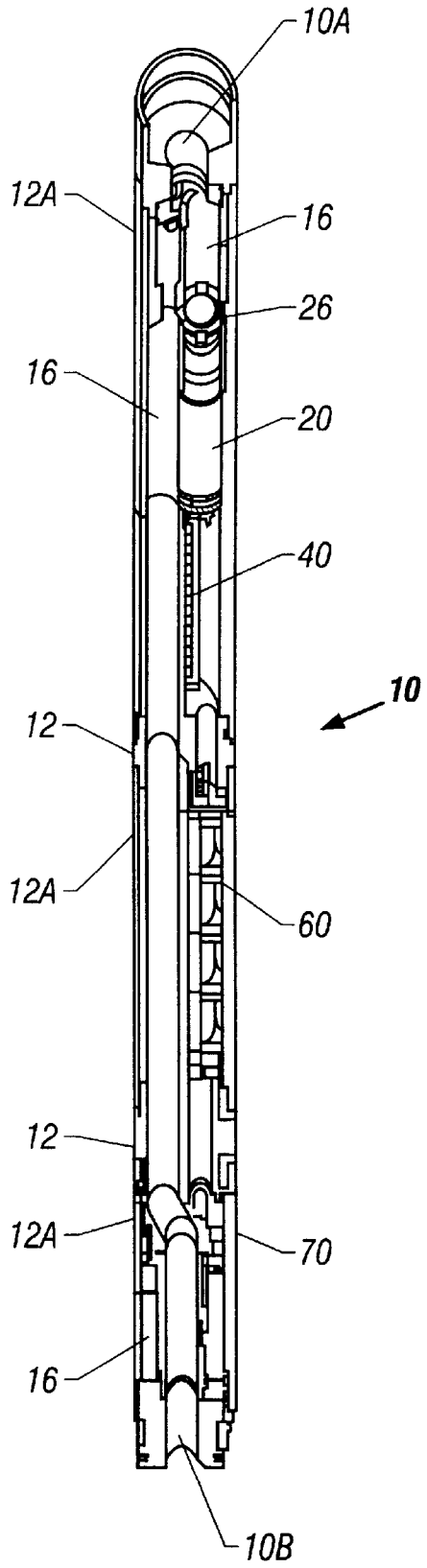
FIG. 1 shows a cutaway view of one embodiment of an apparatus according to the invention.

One embodiment of a signaling apparatus according to the invention is shown in FIG. 1 in cutaway view. The apparatus, shown generally at 10, is disposed inside a substantially cylindrical housing adapted to be coupled to the end of a drill pipe, production tubing, coiled tubing or the like. In this embodiment, for convenience of assembly and maintenance, the housing may be formed from individual sections 12A that are coupled to each other by connectors 12. In this embodiment, the sections 12A each include therein a particular module forming part of the complete apparatus 10. In one embodiment, one of the modules in this embodiment includes a signaler 20 and a processor/controller 40. The processor/controller 40 can be of any type known in the art for receiving signals from an initiator and operating a telemetry transmitter in a manner corresponding to the signals received from the initiator.

A second one of the modules can include an electric power source 60, which in this embodiment comprises at least one battery, such as a lithium battery. The actual type of electric power source used in any particular embodiment of the invention is a matter of choice for the designer and is not intended to limit the invention. As will be readily appreciated by those skilled in the art, however, using batteries substantially reduces the complexity of the apparatus as compared with using turbines or other power sources operated by fluid flow through the apparatus.

A third module in this embodiment includes an initiator 70. The initiator 70 may be operatively coupled to the processor/controller 40, as will be further explained, to operate the signaler 20 in a manner corresponding to the occurrence of selected events. The sections 12A also define therein a fluid channel 16. The fluid channel 16 is adapted to direct flow of fluids, such as drilling, completion or treatment fluids, along the interior of the apparatus 10, as will be further explained.

In this embodiment, the signaler 20 includes a selectively operable flow diverter 26. The flow diverter 26 is hydraulically interposed within the segment of the fluid channel 16 that is formed within the signaler section 12A. In one embodiment, as will be explained in more detail, the flow diverter 26 comprises a piston coupled to an actuator (not shown in FIG. 1). As will be further explained, when the piston of flow diverter 26 is in a retracted position, fluid entering the upper end 10A of the apparatus 10 is free to flow along a first flow path (not shown in FIG. 1) in the fluid channel 16 to the lower end 10B of the apparatus 10. Some of the fluid also flows along a second flow path (not shown in FIG. 1) in the fluid channel 16, as will be further explained. When the piston of flow diverter 26 is extended by the actuator (not shown in FIG. 1) at least some fluid flow is diverted to the second flow path (not shown in FIG. 1), out through the lower end 10B of the apparatus 10. In one embodiment, substantially or entirely all of the fluid flow is diverted.

The initiator 70 is adapted to sense the occurrence of event(s). The types of events that may be sensed by the initiator 70 are varied. Depending on the type of event, the initiator 70 may include at least one detector, software program, analyzer, timer, or sensor (to name a few), which function to enable the initiator 70 to sense the event. Generally and among others, the event can comprise the detection of certain downhole components, sensing certain wellbore conditions, sensing certain tool string or individual component conditions, sensing certain formation characteristics, the expiration of a period of time, the execution of a software program or subroutine, or the reception or transmission of a signal from or to components at the surface or in the wellbore.

More specifically and also among others, the event can comprise the detection of casing collars (with the inclusion of a casing collar locator), sensing a certain wellbore or tool temperature (with the inclusion of temperature sensor), sensing a certain wellbore or tool pressure (with the inclusion of a pressure sensor), sensing a certain wellbore or tool orientation (with the inclusion of an orientation sensor), sensing a certain downhole chemical composition such as pH or capacitance (with the inclusion of a chemical composition sensor such as pH or capacitance meter), sensing a certain flow rate (with the inclusion of a flow rate sensor), sensing nuclear magnetic resonance from the tool string surroundings (with the inclusion of a nuclear magnetic resonance sensor), sensing gamma ray returns from the tool string surroundings (with the inclusion of a gamma ray detector), sensing a certain distance from a point located in the wellbore (with the inclusion of a proximity sensor), sensing the completion of a function by a tool or tool component (with the inclusion of a function completion sensor), sensing the failure of a tool or tool component (with the inclusion of a failure sensor), sensing the execution of a software program or subroutine (with the inclusion of an appropriate flag, for instance), receiving a signal such as data or a command from the surface or from another point in the wellbore (with the inclusion of an appropriate receiver), transmitting a signal such as data or a command to the surface or to another point in the wellbore (with the inclusion of an appropriate transmitter), or sensing a certain status in the tool or other tools and components (with the inclusion of an appropriate status sensor). These types of events (and their respective sensors, etc.) are meant only to serve as examples which may be used in embodiments of the invention and are not intended to limit the types of events which may be used with any particular embodiment of the invention.

By way of example of the different types of events, in one embodiment, the initiator 70 may be adapted to detect the presence of casing collars, in which case it would include a magnetic flux type casing collar locator. This type of collar locator is well known in the art and generally includes a permanent magnet (not shown in FIG. 1) to magnetize steel casing in a wellbore (not shown in FIG. 1) and a detector coil (not shown in FIG. 1) in which are induced voltages related to changes in the magnetic flux passing therethrough. The operation of the collar locator as it pertains to the apparatus 10 will be further explained.

Figure 2:
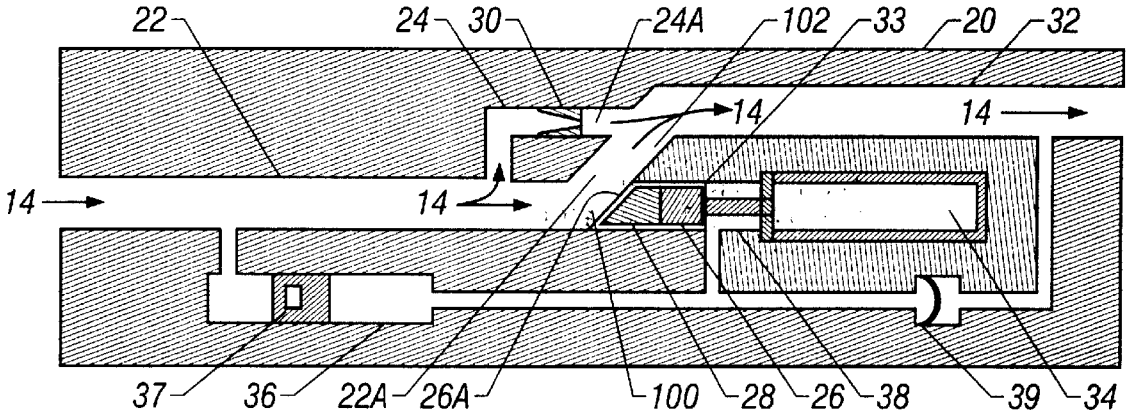
FIGS. 2 and 3 show a schematic diagram of a signal generator section in the embodiment of FIG. 1, where a signal generator valve is shown in open and closed positions, respectively.
Figure 3:
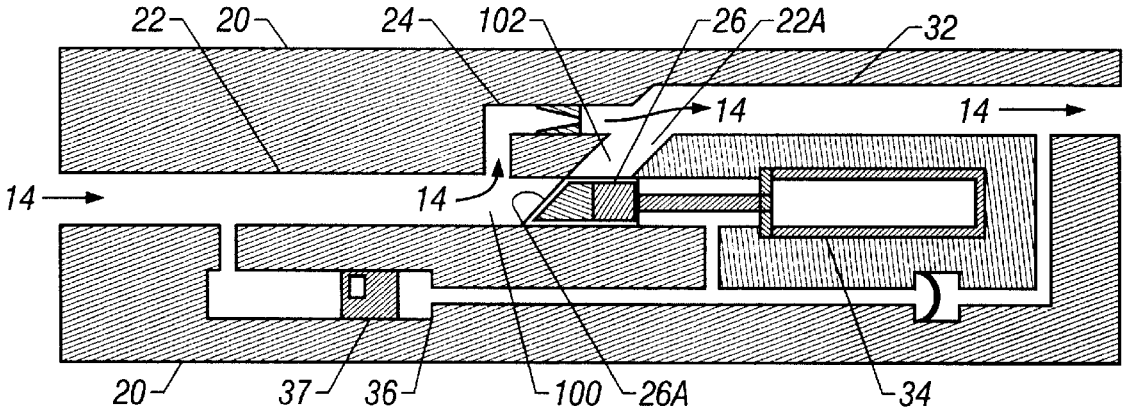

The signaler 20 is shown in more detail in the schematic diagrams in FIGS. 2 and 3. Referring first to FIG. 2, which shows the previously mentioned piston 26 in the retracted position, fluid flow, shown generally at 14, enters the signaler 20 through an inlet end 22 (which forms part of the fluid channel 16 in FIG. 1) to the previously described first flow path 22A and second flow path 24. The second flow path, shown at 24, includes therein an orifice 30 which has a selected internal diameter and is adapted to fit securely, in this embodiment, into the discharge side 24A of the second flow path 24. The second flow path 24 and the first flow path 22A are joined at their discharge or downstream ends into the discharge or downstream side 32 of the signaler 20 (coupled hydraulically to fluid channel 16 in FIG. 1). As shown in FIG. 2 by arrows, when the piston 26 is retracted, some of the fluid flow 14 passes through the first flow path 22A, while other, smaller portions of the fluid flow 14 may pass through the second flow path 24. The first 22A and second 24 flow paths are shown in FIG. 2 as being located along the interior of the signaler 20. It should be clearly understood that the actual direction of fluid flow along either the first 22A or second path may be in any direction with respect to the length of the signaler 20 and apparatus 10. It is only necessary that the fluid flow ultimately enter the apparatus 10 at one end thereof and exit the apparatus 10 at the other end. The first 22A and second 24 flow paths may thus take any configuration internal to the apparatus 10 which enables such fluid entry and exit from the apparatus 10 while diverting the fluid flow as explained herein. Accordingly, the term "along the interior" as used to define the fluid paths 22A, 24 is intended to include within its scope any such internal configuration of fluid flow.

In one embodiment, the second flow path 24 is positioned so that the orifice 30 is accessible from the discharge side 32 of signaler 20. In another embodiment, the second flow path 24 is positioned so that the orifice 30 is accessible from the inlet side 22 of signaler 20. Having the orifice 30 accessible from either the discharge side 32 or the inlet side 22 enables the quick and efficient removal of the orifice 30. For example, if the orifice 30 is accessible from the inlet side 22, an operator simply needs to disassemble the portions of apparatus 10 above the signaler 20 (which portions are typically few and are easily disassembled) to remove the orifice 30. The orifice 30 may be included in the second flow path 24 in any other manner which makes it possible to remove the orifice 30 from the signaler 20. Therefore the position of the orifice 30 and the configuration of the flow paths 22, 22A, 24, 32 shown in FIGS. 2 and 3 are not meant to limit the scope of the invention. The significance of the removable orifice 30 will be further explained.

The piston 26, as previously explained, in this embodiment is moved along a corresponding bore 28 by an actuator 34, which may be a linear actuator. Typically the piston 26 will be sealed within the bore 28 by a seal, such as shown at 33, and is able to move axially along the bore 28. The actuator 34 in this embodiment is a ball screw operated by an electric motor. Other embodiments may include such devices as a solenoid and ferromagnetic plunger combination. Using an electrically operated actuator has the advantage of simplifying the design of the actuator, thus avoiding complicated and expensive hydraulic systems typically associated with actuators used in prior art MWD systems.

The piston 26 is coupled on its rear face (the face opposite the one exposed to the incoming fluid flow 14) to a pressure compensation system 36. The pressure compensation system includes a pressure compensator 37 in hydraulic communication on one side to the upstream side 100 of the piston 26, and on its other side to a fluid reservoir 38 in hydraulic communication with the back side (rear face) of the piston 26. The reservoir 38 may be filled with hydraulic oil or the like. The compensator 37 in this embodiment is a piston which is free to move along a corresponding bore, but other types of compensator, such as a diaphragm, bellows or the like may be used in other embodiments of a pressure compensation system. The purpose of the pressure compensation system 36 is to provide equal flowing fluid pressure, which is the fluid flow 14 pressure at the upstream side 100 of the piston 26, to both sides (upstream side 100 and rear face) of the piston 26. By equalizing the pressure on both sides (upstream side 100 and rear face) of the piston 26, the actuator 34 need only provide enough force to the piston 26 to overcome seal friction, rather than having to additionally overcome differential pressure caused by the fluid flow 14 through the signaler 20. This feature reduces the size and power requirements of the actuator 34 as compared with unbalanced flow diverter systems.

In this embodiment, a safety valve 39, which in this embodiment is a rupture disc, can be disposed in the pressure compensation system 36 in hydraulic communication with the reservoir 38 on one side, and with the downstream side 102 of the piston 26 on its other side. Other embodiments may include a pressure relief valve as the safety valve 39. The purpose of the safety valve 39 is to provide a mechanism to hydraulically move the piston 26 to its retracted position in the event differential pressure across the signaler 20 exceeds a preselected value. The operation of the safety valve 39 will be further explained.

Referring now to FIG. 3, when the piston 26 is moved along the bore 28 by the actuator 34 to its extended position, the first fluid flow path 22A is partially or substantially completely closed to the fluid flow 14. At least some of the fluid flow is thus diverted to the second flow path 24, which includes therein the orifice 30. In one embodiment, substantially or entirely all of the fluid flow is diverted. Because at least some of the fluid flow 14 is diverted through the orifice 30, which may have a smaller opening than the internal diameter of the first flow path 22A, the fluid pressure on the inlet 22 side of the apparatus 10 (upstream side 100 of piston 26) will increase. As previously explained, the orifice 30 can be changed by access through the discharge side 32 or the inlet side 22 of the fluid flow path. The orifice 30 may be held in place by threads, or any other mechanism adapted to make the orifice 30 held securely in place during operation of the apparatus, yet be easily changeable by the system operator when needed. In this embodiment, the orifice 30 can be selected to provide a detectably large, or any other selected amplitude, pressure increase in the fluid flow when the piston 26 is extended to partially or completely close the first fluid flow path 22A. As will be readily appreciated by those skilled in the art, this particular feature of this embodiment of the invention makes it possible for the apparatus 10 to be used with a wide range of expected fluid flow rates in different wellbores, without having to make the signaler 20 specially adapted to a particular range of fluid flow rates. This may avoid the need, as in prior art signaling systems, to have available a plurality of different signalers each adapted to a particular flow rate range to make the apparatus useful over a number of flow rate ranges.

In this embodiment, the front face 26A of the piston 26 is preferably shaped to efficiently divert any solid material which may be in the fluid flow 14 to the particular passage opened with respect to the piston 26. In this embodiment, the front face 26A is beveled to direct any solids in the fluid flow 14. An advantage offered by the beveled or similarly shaped front face 26A is a reduction in the possibility of solids accumulating in the first and second fluid flow paths 22A, 24 so as to block them. Also, the face 26A properly directs any deliberately introduced solid materials, such as "process balls", which are launched through the coiled tubing, thereby minimizing the possibility of any such process balls or other solids being held by gravity or eddy currents in a corner out of the direct path of fluid flow.

The safety valve 39, as previously explained, is provided to make possible retraction of the piston 26 by the fluid flow 14 in certain circumstances. For example, if the orifice 30 were to become clogged with debris or the like, the pressure increase which would occur on extension of the piston 26 may be excessive and dangerous. When the differential pressure across the safety valve 39 exceeds the selected value, the valve 39 will open, causing the pressure extant in the downstream side 102 of the piston 26 to be applied to the back side (rear face) of the piston 26. Higher fluid pressure on the upstream side 100 of the piston 26 will force the piston 26 to its retracted position, thereby opening the first fluid flow path 22A. The safety valve 39 also provides the ability to retract the piston 26 in the event the actuator 34 fails to operate. The system operator in such cases would only need to increase the rate of fluid flow until the differential pressure between the upstream side 100 and the downstream side 102 exceeds the selected opening pressure of the safety valve 39.

Figure 6:
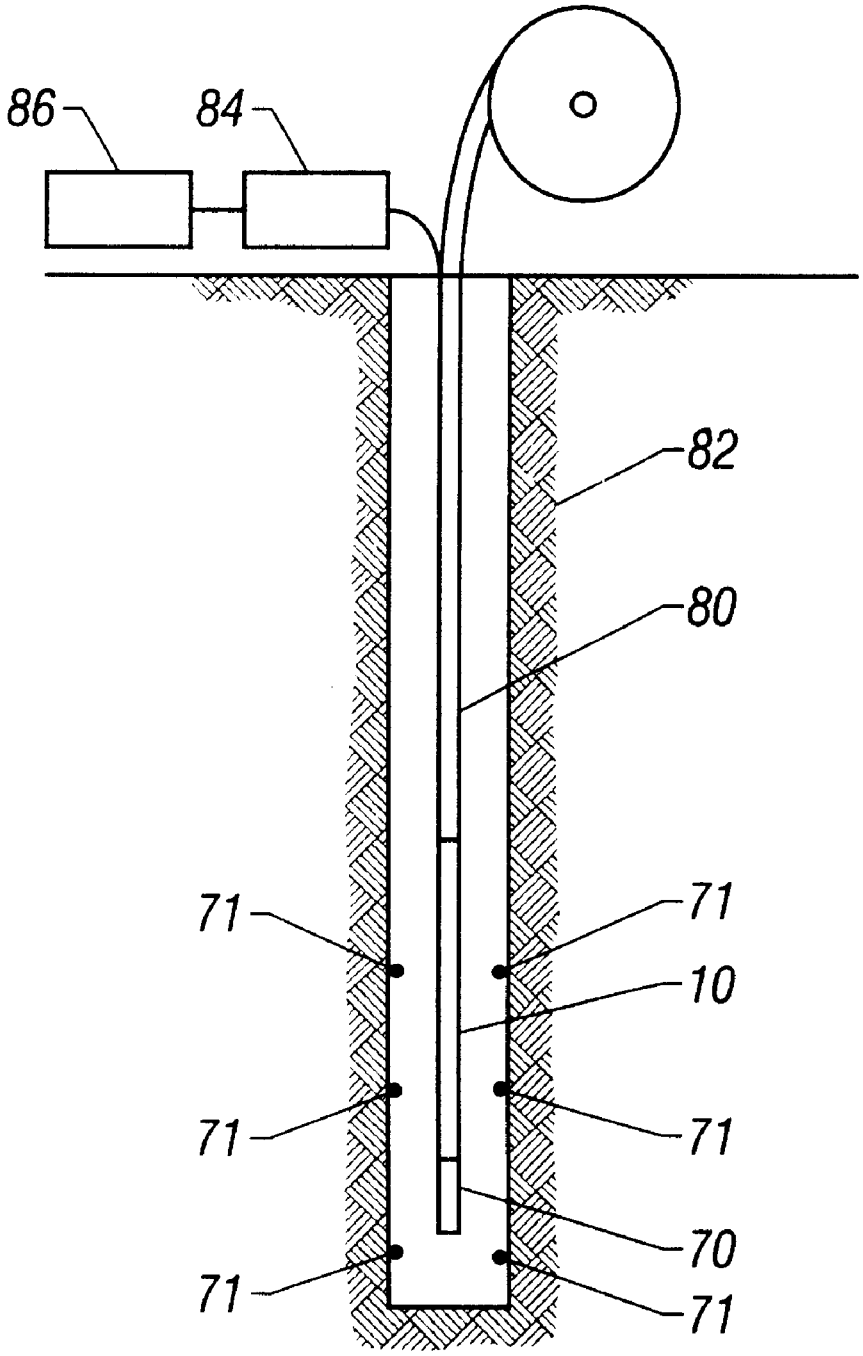
FIG. 6 shows an embodiment of the apparatus attached to the end of a coiled tubing string and disposed in a wellbore.

Referring to FIG. 6, in operation, the initiator 70 produces a signal in response to the detection of sensing of a first event (which can be any of a number of occurrences, as previously discussed). In the embodiment including the controller/processor 40, the signal is transferred to the controller/processor (40 in FIG. 1), whereupon the controller/processor (40 in FIG. 1) transmits an operating signal to the actuator (34 in FIG. 2). In the embodiment not including the controller/processor 40, the signal is transferred to the actuator 34. In response to the signal (in either embodiment), the actuator 34 then causes the flow diverter (26 in FIG. 2) to change position, as previously explained. A change in pressure of the fluid flowing through a coiled tubing 80 to which the apparatus 10 is attached will be detected by a pressure sensor 84 disposed at the earth's surface and in pressure communication with the high pressure side of a fluid circulation system (and therefore the interior of the coiled tubing 80). The pressure measurements made by the sensor 84 can be coupled to a recording and interpretation system 86 of any type known in the art for decoding pressure modulation telemetry. Although the pressure sensor 84 is shown disposed at the earth's surface, in other applications, the pressure sensor may be disposed at a selected depth in the wellbore 82.

In the exemplary embodiment, the initiator 70 includes a casing collar locator which produces a voltage when the locator is moved past a change in magnetic flux path through casing, such as would be found at casing collars 71 in the wellbore 82. Thus, in the exemplary embodiment, the first event is the detection of casing collar. Each time a casing collar is detected by the initiator 70, the initiator 70 sends a signal to the controller/processor 40 or directly to the actuator 34, depending on the embodiment.

Although the apparatus 10 as shown in FIG. 6 is conveyed into the wellbore 82 at the end of coiled tubing 80, it should be clearly understood that other means of conveying the apparatus into the wellbore could be used with the invention, such as drill pipe or production tubing.

Figure 4:
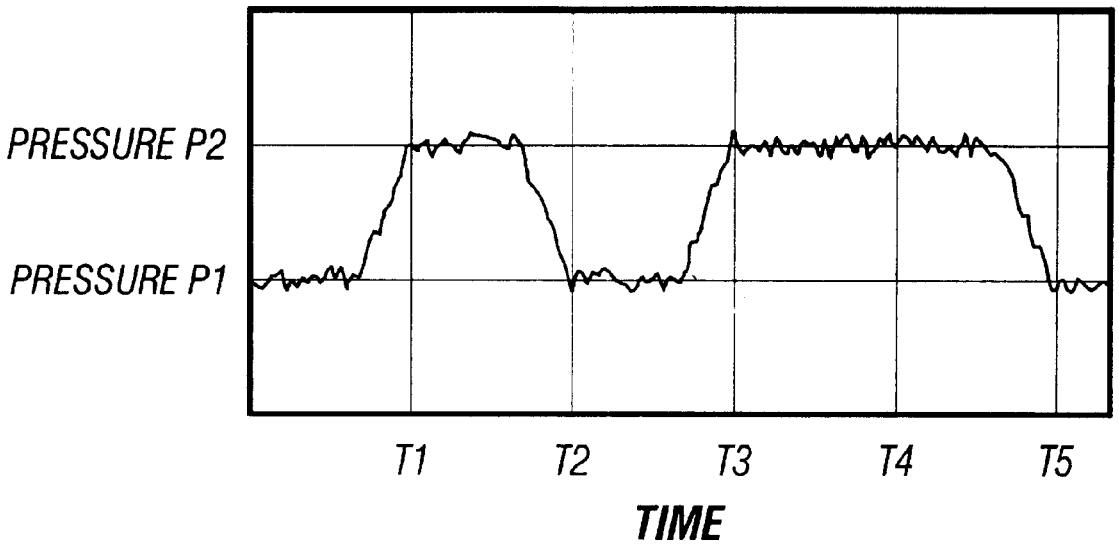
FIG. 4 shows a graph of pressure with respect to time for a telemetry signal generated by the example apparatus in FIG. 1 for one type of telemetry that can be generated using the apparatus of the invention.
Figure 5:
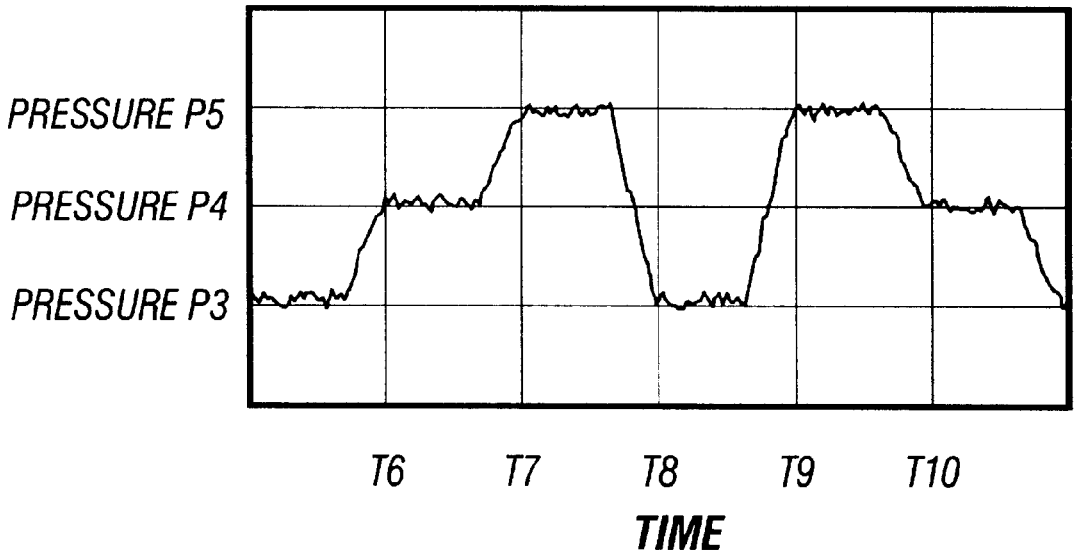
FIG. 5 shows a graph of pressure with respect to time for a telemetry signal generated by the example apparatus in FIG. 1 for another type of telemetry that can be generated using the apparatus of the invention.

Various types of signal telemetry which are possible using the apparatus of the invention are shown in graphic form in FIGS. 4 and 5. FIG. 4 shows a graph of pressure measured by the sensor (84 in FIG. 6) with respect to time. In this embodiment, a voltage pulse which is generated by the initiator 70 is received by the processor/controller 40 which operates the actuator 34 to move the piston to the extended position at time T1. A corresponding pressure increase, from P1 to P2 occurs at T1. After a preselected time interval, which in this embodiment is shown from T1 to T2, the processor/controller 40 operates the actuator 34 to retract the piston 26, resulting in a reduction in pressure from P2 to P1. The length of time between detection of an event which causes the piston to extend and its later retraction, can be programmed into the processor/controller 40 to represent detection of different events, or have any other predetermined meaning or significance. In one example, detection of a casing collar may be represented by a shorter duration pressure increase from T1 to T2, while detection of float equipment may result in a longer time pressure increase, such as from T3 to T5 as shown in FIG. 4. As another example, detection of different types of events by different sensors (not shown in the Figures, but examples of which were provided earlier herein) may result in pressure changes having individually identifiable durations. An example of a different type of event could be having one of the aforementioned temperature sensors in the apparatus, where a temperature event, such as a temperature change exceeding a predetermined threshold would be signaled by producing a pressure increase having a selected time duration corresponding to the "temperature event". Other examples of events could include detection of gamma radiation above a threshold level, such as would occur when a gamma ray detector used as the initiator 70 passed near a radioactive marker. Those skilled in the art will appreciate that the various types of sensors previously described herein, as well as other types of sensors, each may be used to detect a condition which may be characterized in terms of an "event". Each such event detected may result in the apparatus 10 sending a specific coded pressure signal according to the various telemetry schemes explained herein. In one embodiment, each coded pressure signal is event specific.

The actuator (34 in FIG. 2) in this embodiment of the invention (motor operated ball screw) may also move the piston (26 in FIG. 2) to positions intermediate of the fully extended and fully retracted positions. This makes possible another type of telemetry in which more than one magnitude of pressure change may be applied to the fluid flow to indicate different types of detected events. Referring to FIG. 5, one such event, shown as an increase in pressure from P3 to P4, takes place at T6. The pressure increase from P3 to P4 may be performed, for example, by moving the piston 26 halfway from its retracted position to the extended position. At T7, the pressure is increased from P4 to P5, at time T7, by extending the piston 26 the rest of the way to the full extended position. As in the previous example of telemetry format, the duration of each pressure change can be programmed to correspond to any selected event detected by the apparatus 10. Still further, a pressure change from P5 back to P3, shown at T8, may be generated by fully retracting the piston in a single operation. The inverse operation, generating a pressure change from P3 to P5 by fully extending the piston, is shown at T9. Pressure decreases, by retracting the piston halfway are shown from P5 to P4 at T9, and from P4 to P3 at T10. In this embodiment of the invention, the programmer/controller (40 in FIG. 1) may be programmed to operate the actuator (34 in FIG. 2) to move the piston (26 in FIG. 2) an intermediate distance between the fully extended and fully retracted positions so as to produce an intermediate pressure change similar to that shown in FIG. 5 to represent different types of detected events. In addition, the duration of the pressure changes can be selected to represent different types of detected events.

The invention provides an apparatus which can communicate the occurrence of an event by modifying the pressure of a fluid flowing through the apparatus. The apparatus can be used in cases where it is not desirable to selectively divert fluid inside a coiled tubing, drill pipe or tubing to an annular space outside the tubing in the wellbore. Further, the invention in some embodiments provides a signaler which is relatively immune to blockage by solid material in the flowing fluid. Other embodiments of the invention have a selectable orifice so that the apparatus can be adjusted to work in a variety of fluid flow rate ranges without the need to have signalers sized to correspond to the expected flow rate range.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the second path corn rises a selectable flow restriction therein, the selectable flow restriction comprising a selectable orifice.

2. The system as defined in claim 1, wherein:

fluid flows through the first path and the second path when the flow diverter is in the first position; and fluid flows at least substantially through the second path when the flow diverter is in the second position.

3. The system as defined in claim 1, wherein the selectable orifice is accessible from the second flow path for replacement.

4. The system as defined in claim 1 wherein the flow diverter comprises a piston coupled to an actuator.

5. The system as defined in claim 4 wherein the actuator comprises a linear actuator.

6. The system as defined in claim 4 wherein the piston comprises a pressure compensator adapted to equalize pressure across the piston.

7. The system as defined in claim 1 wherein the flow diverter comprises a pressure compensator adapted to equalize pressure on an upstream side and a rear face of the diverter.

8. The system as defined in claim 1 wherein the first event comprises at least one of the detection of certain downhole components, sensing certain wellbore conditions, sensing certain tool string or individual component conditions, sensing certain formation characteristics, the expiration of a period of time, the execution of a software program or subroutine, or the reception or transmission of a signal from or to components at the surface or in the wellbore.

9. The system as defined in claim 8 wherein the initiator comprises at least one of a detector, software program, analyzer, timer, or sensor to enable the initiator to sense the first event.

10. The system as defined in claim 8 wherein the first event comprises at least one of the detection of casing collars, sensing a certain wellbore or tool temperature, sensing a certain wellbore or tool pressure, sensing a certain wellbore or tool orientation, sensing a certain downhole chemical composition, sensing a certain flow rate, sensing nuclear magnetic resonance from the tool string surroundings, sensing gamma ray returns from the tool string surroundings, sensing a certain distance from a point located in the wellbore, sensing the completion of a function by a tool or tool component, sensing the failure of a tool or tool component, sensing the execution of a software program or subroutine, receiving a signal such as data or a command from the surface or from another point in the wellbore, transmitting a signal such as data or a command to the surface or to another point in the wellbore, or sensing a certain status in the tool or other tools and components.

11. The system as defined in claim 10 wherein the initiator comprises at least one of a casing collar locator, temperature sensor, pressure sensor, orientation sensor, chemical composition sensor, flow rate sensor, nuclear magnetic resonance sensor, gamma ray detector, proximity sensor, function completion sensor, failure sensor, a software flag, communication receiver, communication transmitter, or status sensor to enable the initiator to sense the first event.

12. The system as defined in claim 1 further comprising a pressure sensor hydraulically coupled to a fluid flow system adapted to pump fluid along the interior of the housing when the housing is disposed in the wellbore.

13. The system as defined in claim 12 wherein the pressure sensor is disposed at the earth's surface.

14. The system as defined in claim 1 wherein the initiator is adapted to cause operation of the flow diverter to a position intermediate the first position and the second position in response to a second event.

15. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the flow diverter comprises a piston coupled to an actuator, the piston comprising a face exposed to incoming fluid flow adapted to divert solid material in incoming fluid flow into at least one of the first path and the second path.

16. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the flow diverter comprises a piston coupled to an actuator, the piston comprising a pressure compensator adapted to equalize pressure across the piston, and wherein the pressure compensator comprises a safety valve hydraulically coupled to a downstream side of the piston, the safety valve adapted to cause operation of the piston to divert fluid flow to a least restrictive one of the first and second flow paths on application of at least a predetermined differential pressure across the piston.

17. The system as defined in claim 16 wherein the safety valve comprises a rupture disc.

18. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the flow diverter comprises a pressure compensator adapted to equalize pressure on an upstream side and a rear face of the diverter, the pressure compensator comprising a safety valve hydraulically coupled to a downstream side of the flow diverter, the safety valve adapted to cause operation of the flow diverter to a least restrictive one of the first and second flow paths on application of at least a predetermined differential pressure across the flow diverter.

19. The system as defined in claim 18 wherein the safety valve comprises a rupture disc.

20. A system for communication from an instrument disposed in a wellbore, comprising:

a flow diverter selectively operable between a first position and a second position to selectively divert at least some fluid flow from a first oath along the interior of a housing to a second path along the interior of the housing; and an initiator operatively coupled to the flow diverter to cause selective operation thereof in response to a first event, and wherein the initiator comprises a casing collar locator, and the first event comprises detection of a casing collar.

21. The system as defined in claim 20 further comprising a controller adapted to operate the flow diverter for a preselected time interval to divert flow from the first flow path to the second flow path upon detection of a casing collar.

22. The system defined in claim 21 wherein the controller is adapted to cause the operation of the flow diverter, and subsequently cause an opposite operation of the flow diverter after a selected time interval.

23. The system as defined in claim 22 wherein the time interval is selected to correspond to detection of at least one of the first event and a second event.

24. A system for communication from an instrument disposed in a wellbore, comprising:

a flow diverter selectively operable between a first position and a second position to selectively divert at least some fluid flow from a first path alone the interior of a housing to a second path alone the interior of the housing;

an initiator operatively coupled to the flow diverter to cause selective operation thereof in response to a first event; and a controller adapted to operate the flow diverter for a preselected time interval to divert flow from the first flow path to the second flow path in response to the first event.

25. The system as defined in claim 24 wherein the controller is adapted to cause the operation of the flow diverter, and subsequently cause an opposite operation of the flow diverter after a selected time interval.

26. The system as defined in claim 25 wherein the time interval is selected to correspond to detection of at least one of the first event and a second event.

27. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the initiator is adapted to cause operation of the flow diverter to a position intermediate the first position and the second position in response to at least one of the first event and a second event.

28. A system for communication from an instrument disposed in a wellbore, comprising:

a flow diverter selectively operable between a first position and a second position to selectively divert at least some fluid flow from a first path along the interior of a housing to a second path along the interior of the housing;

an initiator operatively coupled to the flow diverter to cause selective operation thereof in response to a first event; and a pressure sensor hydraulically coupled to a fluid flow system adapted to pump fluid along the interior of the housing when the housing is disposed in the wellbore, and wherein the pressure sensor is disposed at a selected depth in the wellbore.

29. A system for communication from an instrument disposed in a wellbore, comprising:

a flow diverter selectively operable between a first position and a second position to selectively divert at least some fluid flow from a first path along the interior of a housing to a second path alone the interior of the housing;

an initiator operatively coupled to the flow diverter to cause selective operation thereof in response to a first event;

a pressure sensor hydraulically coupled to a fluid flow system adapted to pump fluid along the interior of the housing when the housing is disposed in the wellbore; and a recording system operatively coupled to the pressure sensor and adapted to detect a change in pressure corresponding to operation of the flow diverter, the recording system adapted to generate an indication of the first event in response to the detecting pressure change corresponding to operation of the flow diverter.

30. A system for communication from an instrument disposed in a wellbore, comprising:

a flow diverter selectively operably between a first position and a second position to selectively divert at least some fluid flow from a first path along the interior of a housing to a second path along the interior of the housing; and an initiator operatively coupled to the flow diverter to cause selective operation thereof in response to a first event, and wherein the housing is adapted to be coupled to one end of a coiled tubing and inserted into the wellbore by unreeling the coiled tubing therein.

31. A system for communication from an instrument disposed in a wellbore, comprising:

a flow diverter selectively operable between a first position and a second position to selectively divert at least some fluid flow from a first path along the interior of a housing to a second path alone the interior of the housing; and an initiator operatively coupled to the flow diverter to cause selective operation thereof in response to a first event, and wherein the initiator is disposed in a first module, the flow diverter and first and second flow paths are disposed in a second module, and a power supply is disposed in a third module, the modules adapted to be coupled to at least one of the other modules, and at least one of the modules adapted to be coupled to one end of at least one of a coiled tubing, production tubing and drill pipe.

32. The system as defined in claim 31 wherein the second flow path comprises a selectable orifice therein, the orifice accessible from the second flow path for replacement.

33. A system for communication from an instrument disposed in a wellbore, comprising:

a flow diverter selectively operable between a first position and a second position to selectively divert at least some fluid flow from a first path along the interior of a housing to a second path along the interior of the housing; and an initiator operatively coupled to the flow diverter to cause selective operation thereof in response to a first event, and wherein the flow diverter comprises a piston coupled to a linear actuator, the linear actuator comprising a ball screw coupled to an electric motor.

34. A system for communication from an instrument disposed in a wellbore, comprising:

a flow diverter disposed in a first module, the flow diverter selectively operable between a first position and a second position to selectively divert at least some fluid flow from a first path along the interior of the first module to a second path along the interior of the first module;

an initiator disposed in a second module operatively coupled to the flow diverter to cause selective operation thereof in response to a first event; and a power supply disposed in a third module for operating the initiator and the flow diverter, the first, second and third modules adapted to be coupled to at least one of the other modules, at least one of the first, second and third modules adapted to be coupled to at least one of a drill pipe, coiled tubing and a production tubing.

35. The system as defined in claim 34, wherein:

fluid flows through the first path and the second path when the flow diverter is in the first position; and fluid flows at least substantially through the second path when the flow diverter is in the second position.

36. The system as defined in claim 34 wherein the power supply comprises at least one battery.

37. The system as defined in claim 34 wherein the battery comprises a lithium battery.

38. The system as defined in claim 34 wherein the second flow path comprises a selectable orifice.

39. The system as defined in claim 34 wherein the flow diverter comprises a piston coupled to an actuator.

40. The system as defined in claim 39 wherein the actuator comprises a linear actuator.

41. The system as defined in claim 40 wherein the linear actuator comprises a ball screw coupled to an electric motor.

42. The system as defined in claim 39 wherein the piston comprises a face exposed to incoming fluid flow adapted to divert solid material in incoming fluid flow into at least one of the first flow path and the second flow path.

43. The system as defined in claim 39 the piston comprises a pressure compensator adapted to equalize pressure on across the piston.

44. The system as defined in claim 43 wherein the pressure compensator comprises a safety valve hydraulically coupled to a downstream side of the piston, the safety valve adapted to cause operation of the piston to divert flow to a least restrictive one of the first and second flow paths on application of at least a predetermined differential pressure across the piston.

45. The apparatus as defined in claim 44 wherein the safety valve comprises a rupture disc.

46. The system as defined in claim 34 wherein the flow diverter comprises a pressure compensator adapted to equalize pressure on an upstream side and a rear face of the flow diverter.

47. The system as defined in claim 46 wherein the pressure compensator comprises a safety valve hydraulically coupled to a downstream side of the flow diverter, the safety valve adapted to cause operation of the flow diverter to a least restrictive one of the first and second flow paths on application of at least a predetermined differential pressure across the flow diverter.

48. The apparatus as defined in claim 47 wherein the safety valve comprises a rupture disc.

49. The system as defined in claim 34 wherein the initiator comprises a casing collar locator, and the first event comprises detection of a casing collar.

50. The system as defined in claim 49 further comprising a controller adapted to operate the flow diverter for a preselected time interval to divert flow from the first flow path to the second flow path upon detection of a casing collar.

51. The system as defined in claim 50 wherein the controller is adapted to cause operation of the flow diverter and to cause an opposite operation of the flow diverter after a selected time interval.

52. The system as defined in claim 51 wherein the time interval is selected to correspond to detection of at least one of the first event and a second event in the wellbore.

53. The system as defined in claim 34 the initiator is adapted to cause operation of the flow diverter to a position intermediate the first position and the second position in response to a second event.

54. The system as defined in claim 34 wherein the initiator is adapted to cause operation of the flow diverter to a position intermediate the first position and the second position in response to at least one of the first event and a second event.

55. The system as defined in claim 34 wherein the first event comprises at least one of the detection of certain downhole components, sensing certain wellbore conditions, sensing certain tool string or individual component conditions, sensing certain formation characteristics, the expiration of a period of time, the execution of a software program or subroutine, or the reception or transmission of a signal from or to components at the surface or in the wellbore.

56. The system as defined in claim 55 wherein the initiator comprises at least one of a detector, software program, analyzer, timer, or sensor to enable the initiator to sense the first event.

57. The system as defined in claim 55 wherein the first event comprises at least one of the detection of casing collars, sensing a certain wellbore or tool temperature, sensing a certain wellbore or tool pressure, sensing a certain wellbore or tool orientation, sensing a certain downhole chemical composition, sensing a certain flow rate, sensing nuclear magnetic resonance from the tool string surroundings, sensing gamma ray returns from the tool string surroundings, sensing the proximity of a certain point located in the wellbore, sensing the completion of a function by a tool or tool component, sensing the failure of a tool or tool component, sensing the execution of a software program or subroutine, receiving a signal such as data or a command from the surface or from another point in the wellbore, transmitting a signal such as data or a command to the surface or to another point in the wellbore, or sensing a certain status in the tool or other tools and components.

58. The system as defined in claim 57 wherein the initiator comprises at least one of a casing collar locator, temperature sensor, pressure sensor, orientation sensor, chemical composition sensor, flow rate sensor, nuclear magnetic resonance sensor, gamma ray detector, proximity sensor, function completion sensor, failure sensor, a software flag, communication receiver, communication transmitter, or status sensor to enable the initiator to sense the first event.

59. The system as defined in claim 34 further comprising a pressure sensor hydraulically coupled to a fluid flow system adapted to pump fluid along the interior of the housing when the housing is disposed in the wellbore.

60. The system as defined in claim 59 wherein the pressure sensor is disposed at the earth's surface.

61. The system as defined in claim 59 wherein the pressure sensor is disposed at a selected depth in the wellbore.

62. The system as defined in claim 34 further comprising a recording system coupled to the pressure sensor and adapted to detect a change in pressure corresponding to operation of the flow diverter, the recording system adapted to generate an indication of the first event in response to the detecting pressure change corresponding to the operation of the flow diverter.

63. A method for communicating from an instrument disposed in a wellbore, comprising:

causing fluid to flow through the instrument;

sensing a first event in the wellbore;

selectively operating a flow diverter between a first position and a second position in response to the sensing of the first event to selectively divert at least some of the flowing fluid from a first path along the interior of the instrument to a second path along the interior of the instrument;

detecting a change in pressure in the flowing fluid resulting from diverting at least some of the flowing fluid from the first path to the second path; and generating an indication of the event in response to the detected pressure change, and wherein the detecting the change in pressure is performed at a selected depth in the wellbore.

64. The method of claim 63 wherein:

fluid flows through the first path and the second path when the flow diverter is in the first position; and fluid flows substantially through the second path when the flow diverter is in the second position.

65. The method defined in claim 63 wherein the sensing the first event comprises at least one of:

detecting certain downhole components, sensing certain wellbore conditions, sensing certain tool string or individual component conditions, sensing certain formation characteristics, the expiration of a period of time, the execution of a software program or subroutine, or the reception or transmission of a signal from or to components at the surface or in the wellbore.

66. A method for communicating from an instrument disposed in a wellbore, comprising:

causing fluid to flow through the instrument;

sensing a first event in the wellbore;

selectively operating a diverter between a first position and a second position in response to the sensing of the first event to selectively divert at least some of the flowing fluid from a first path along the interior of the instrument to a second path along the interior of the instrument;

detecting a change in pressure in the flowing fluid resulting from diverting at least some of the flowing fluid from the first path to the second path; and generating an indication of the event in response to the detected pressure change, and wherein the detecting the change in pressure is performed substantially at the earth's surface.

67. The method as defined in claim 63 further comprising selecting a restriction in at least one of the firs and second flow paths to provide a selected amplitude of pressure change when the fluid flow is diverted between the first path and the second path.

68. The method as defined in claim 65 wherein the sensing the first event comprises at least one of:

detecting casing collars, sensing a certain wellbore or tool temperature, sensing a certain wellbore or tool pressure, sensing a certain wellbore or tool orientation, sensing a certain downhole chemical composition, sensing a certain flow rate, sensing nuclear magnetic resonance from the tool string surroundings, sensing gamma ray returns from the tool string surroundings, sensing the proximity of a pertain point located in the wellbore, sensing the completion of function by a tool or tool component, sensing the failure of a toot or tool component, sensing the execution of a software program or subroutine, receiving a signal such as data or a command from the surface or from another point in the wellbore, transmitting a signal such as data or a command to the surface or to another point in the wellbore, or sensing a certain status in the tool or other tools and components.

69. A method for communicating from an instrument disposed in a wellbore, comprising:

causing fluid to flow through the instrument;

sensing a first event in the wellbore; and selectively operating a flow diverter between a first position and a second position in response to the sensing of the first event to selectively divert at least some of the flowing fluid from a first path along the interior of the instrument to a second path along the interior of the instrument, and wherein the sensing the first event comprises determining movement of the instrument past a casing collar disposed in the wellbore.

70. A method for communicating from an instrument disposed in a wellbore, comprising:

causing fluid to flow through the instrument;

sensing a first event in the wellbore;

selectively operating a flow diverter between a first position and a second position in response to the sensing of the first event to selectively divert at least some of the flowing fluid from a first path along the interior of the instrument to a second path along the interior of the instrument; and operating the flow diverter to a position intermediate the first position and the second position in response to a second event.

71. The method as defined in claim 70 further comprising:

detecting a change in pressure in the flowing fluid resulting from the intermediate position of the flow diverter; and generating an indication of the event in response to the detected pressure change.

72. The method as defined in claim 71 the detecting the change in pressure is performed substantially at the earth's surface.

73. The method as defined in claim 71 wherein the detecting the change in pressure is performed at a selected depth in the wellbore.

74. A method for communicating from an instrument disposed in a wellbore, comprising:

causing fluid to flow through the instrument;

sensing a first event in the wellbore;

selectively operating a flow diverter between a first position and a second position in response to the sensing of the first event to selectively divert at least some of the flowing fluid from a first path along the interior of the instrument to a second path along the interior of the instrument; and operating the flow diverter between a position intermediate the first position and the second position in response to at least one of the first event and a second event.

75. A method for communicating from an instrument disposed in a wellbore, comprising:

causing fluid to flow through the instrument;

sensing a first event in the wellbore; and selectively operating a flow diverter between a first position and a second position in response to the sensing of the first event to selectively divert at least some of the flowing fluid from a first path along the interior of the instrument to a second path along the interior of the instrument, and wherein the selectively diverting the fluid flow is performed for a preselected time interval upon detecting a casing collar in the wellbore.

76. The method for communicating from an instrument disposed in a wellbore, comprising:

causing fluid to flow through the instrument;

sensing a first event in the wellbore;

selectively operating a flow diverter between a first position and a second position in response to the sensing of the first event to selectively divert at least some of the flowing fluid from a first path along the interior of the instrument to a second path along the interior of the instrument; and reversing the selectively diverting the fluid flow after a selected time interval.

77. The method as defined in claim 76 wherein the time interval is selected to correspond to at least one of the first event and a second event.

78. A method for communicating from an instrument disposed in a wellbore; comprising:

causing fluid to flow through the instrument;

sensing a first event in the wellbore;

selectively operating a flow diverter between a first position and a second position in response to the sensing of the first event to selectively divert at least some of the flowing fluid from a first path along the interior of the instrument to a second path along the interior of the instrument;

selecting a restriction in at least one of the first and second flow paths to provide a selected amplitude of pressure change when at least some of the fluid flow is diverted from the first path to the second path;

detecting a change in pressure in the flowing fluid resulting from the diverting the flowing fluid from the first path to the second path; and generating an indication of the event in response to the detected pressure change.

79. The method as defined in claim 78 wherein the detecting the change in pressure is performed substantially at the earth's surface.

80. The method as defined in claim 78 wherein the detecting the change in pressure is performed at a selected depth in the wellbore.

* * * * *

UNITED STATES PATENT AND TRADEMARK OFFICE

CERTIFICATE OF CORRECTION

PATENT NO. : 6,604,582 B2
APPLICATION NO. : 09/843634
DATED : August 12, 2003
INVENTOR(S) : Flowers et al.

It is certified that error appears in the above-identified patent and that said Letters Patent is hereby corrected as shown below:

Column 9, Claim 1, Line 11 “com rises” corrected as “comprises”

Signed and Sealed this

Twentieth Day of January, 2009

JON W. DUDAS
*Director of the United States Patent and Trademark Office*